US012285044B2

(12) United States Patent
Gerber

(10) Patent No.: US 12,285,044 B2
(45) Date of Patent: Apr. 29, 2025

(54) ASHTRAY AND STORAGE DEVICE

(71) Applicant: BRH International, Inc., Las Vegas, NV (US)

(72) Inventor: Bryan Gerber, Las Vegas, NV (US)

(73) Assignee: BRH International, Inc., Las Vegas, NV (US)

( * ) Notice: Subject to any disclaimer, the term of this patent is extended or adjusted under 35 U.S.C. 154(b) by 206 days.

(21) Appl. No.: 18/115,050

(22) Filed: Feb. 28, 2023

(65) Prior Publication Data

US 2024/0277043 A1 Aug. 22, 2024

Related U.S. Application Data

(63) Continuation-in-part of application No. 29/885,121, filed on Feb. 21, 2023.

(51) Int. Cl.

| | |
|---|---|
| ***A24F 19/10*** | (2006.01) |
| ***A24F 9/10*** | (2006.01) |
| ***A24F 19/00*** | (2006.01) |
| ***B65D 25/04*** | (2006.01) |
| ***B65D 43/02*** | (2006.01) |

(Continued)

(52) U.S. Cl.

CPC ..... *A24F 19/10* (2013.01); *A24F 9/10* (2013.01); *A24F 19/0085* (2013.01); *B65D 25/04* (2013.01); *B65D 43/0202* (2013.01); *B65D 43/16* (2013.01); *B65D 51/18* (2013.01); *B65D 51/24* (2013.01); *B65D 2251/0003* (2013.01); *B65D 2543/00092* (2013.01); *B65D 2543/00305* (2013.01)

(58) Field of Classification Search

CPC ..... A24F 19/10

See application file for complete search history.

(56) References Cited

U.S. PATENT DOCUMENTS

| | | | | |
|---|---|---|---|---|
| 11,647,784 | B1 | 5/2023 | Matthews | |
| 2018/0116279 | A1 * | 5/2018 | Donoho | A24F 19/0085 |

(Continued)

FOREIGN PATENT DOCUMENTS

| | | | | |
|---|---|---|---|---|
| KR | 20030082878 | A * | 10/2003 | |
| KR | 101594487 | B1 * | 2/2016 | |
| WO | WO-2008019405 | A2 * | 2/2008 | A24F 19/005 |

OTHER PUBLICATIONS

PCT International Searching Authority, Form PCT/ISA/237, Written Opinion of the International Searching Authority, PCT/US2024/016617.

(Continued)

*Primary Examiner* — Cynthia Szewczyk

(74) *Attorney, Agent, or Firm* — McGeary Cukor LLC; Vincent E McGeary

(57) ABSTRACT

An ashtray according to the principles of the invention includes a container portion having two internal sections where the container is configured to receive a first lid. The first lid includes topical features for use as an ash tray and defines holes to allow ashes to drop into section of the container. In one embodiment, the first lid also includes a second section covered with a hinged cover. This section defines an aperture to another portion of the container which is preferable configured to store accessories. A second lid is configured to cover the first lid. When the second lid covers the first lid, the ashtray is substantially odor free.

18 Claims, 10 Drawing Sheets

(51) Int. Cl.

| | |
|---|---|
| ***B65D 43/16*** | (2006.01) |
| ***B65D 51/18*** | (2006.01) |
| ***B65D 51/24*** | (2006.01) |

(56) References Cited

U.S. PATENT DOCUMENTS

| | | | |
|---|---|---|---|
| 2019/0000140 | A1 | 1/2019 | Manning |
| 2022/0151291 | A1 | 5/2022 | Dublin |
| 2022/0322739 | A1 | 10/2022 | Miqbel |

OTHER PUBLICATIONS

PCT/ISA/206, PCT/US2024/016617, dated Jun. 17, 2024.
Non-Final Office Action, USPTO, U.S. Appl. No. 18/210,637, dated Nov. 9, 2023.
Final Office Action, USPTO, U.S. Appl. No. 18/210,637, dated Feb. 29, 2024.

* cited by examiner

ASHTRAY AND STORAGE DEVICE

CROSS-REFERENCE TO RELATED APPLICATIONS

This application is a continuation-in-part of, and claims priority to, U.S. patent application Ser. No. 29/885,121, entitled "Ornamental Design for a Cache Cup Ashtray," filed on Feb. 21, 2023, which is also incorporated by reference.

FIELD OF THE INVENTION

This invention relates generally to the field of accessories for use in smoking, and more particularly to the field of combination portable ash trays and storage devices.

BACKGROUND

It is estimated that between 30 and 40 million people in the United States enjoy using smokable substances, such as cigarettes, cigars, herbals and even smokable teas. Despite the widespread use of smokable products in the United States and around the world, ashtrays have been almost completely phased out of automobiles. While smoking in cars with passengers can be socially, and in some cases legally, unacceptable, many smokers own and operate their vehicles without passengers. These smokers from time to time may wish to enjoy a smoke in their car while on a break from driving.

Likewise, due to the widespread adoption of regulations prohibiting smoking in-doors, smokers more and more enjoy their products outside. Unfortunately, in many locations designated smoking areas are no longer provided. Therefore, smokers often find it difficult to locate an appropriate waste receptacle when smoking. Predictably, this leads to indiscriminate users discarding ashes and smoke waste products on the ground.

Even when vehicle ashtrays were standard equipment on motor vehicles, they were poorly designed and inadequate. Vehicle ashtrays were difficult to remove for cleaning. They were often too small to hold unsmoked waste product along with the spent ashes. They were not odor proof, even when closed. Automobiles did not provide adequate storage for accessories near ashtrays. As a result, drivers often left vehicle ashtrays open, exposing the unpleasant smell and waste to the passengers.

There is a need, therefore, for an ash receptacle that meets the needs of the modern smoker.

SUMMARY

An ashtray according to the principles of the invention comprises a generally cylindrical shape defining an interior volume open on one end. The open end is sized to removably receive a first lid configured topologically with forms for utility in smoking, such as a pyramid debowler and indentations for resting smoking devices, in a bowl or indentation. A second, odor resistant, lid is configured to cover the ashtray lid to make the ashtray odorless when desired, and also to cover the ash waste.

The ashtray container and ashtray lid are preferably made from heat and impact resistant material, such as silicone. The second, covering, lid can be made from any material capable of trapping odors and, preferably, resistant to absorbing odors, such as silicone or plastic. The cylindrical volume can be sectioned so that one or more specified sections can act as a storage container, such as for rolled goods, lighters, tools and other accessories that will be apparent to the skilled artisan after reading this disclosure.

In an illustrative embodiment according to the principles of the invention, the ashtray lids and storage container are shaped to appear like a typical coffee cup. The volume is sized to fit within a typical coffee cup holder as generally provided in consumer automobiles. As shown in related pending patent application Ser. No. 29/885,121, entitled "Ornamental Design for a Cache Cup Ashtray," which is incorporated herein by reference, the ashtray according to the invention can be ornamented to appear as a travel coffee cup with lid. A person of ordinary skill in the art will understand after reading this disclosure that other shapes can be used without departing from the principles of the invention. The container portion can also be made of heat resistant silicone, which is non-stick and does not burn or warp in typical usage.

In one aspect of the invention, the ash tray lid is configured with a poker or debowler, illustratively pyramid shaped. This poker has utility in removing ash from smoking devices having bowls, such as pipes, glass bowls or the like without having to bang or shake the smoking device. In another aspect, a resting area for rolled smokable, like cones or cigarettes, is provided. Such features are referred to as ash working features.

In another aspect of the invention, the container portion of the ashtray is divided, at least into two sections. One section is illustratively used to collect ash and waste while the other section holds accessories.

In another aspect, the ashtray lid is also sectioned such that the section formed with smoking attributes can be positioned over the container section for collecting ash. A hinged section with pull tab can be opened to reveal and access the storage section of the container.

In another aspect of the invention, the ashtray lid is provided separately and equipped with a resilient indentation around the underside circumference so that it can be affixed to an appropriately sized cup.

In another aspect of the invention, the container and lid are various shapes and not necessarily round.

DETAILED DESCRIPTION

Figure 1:
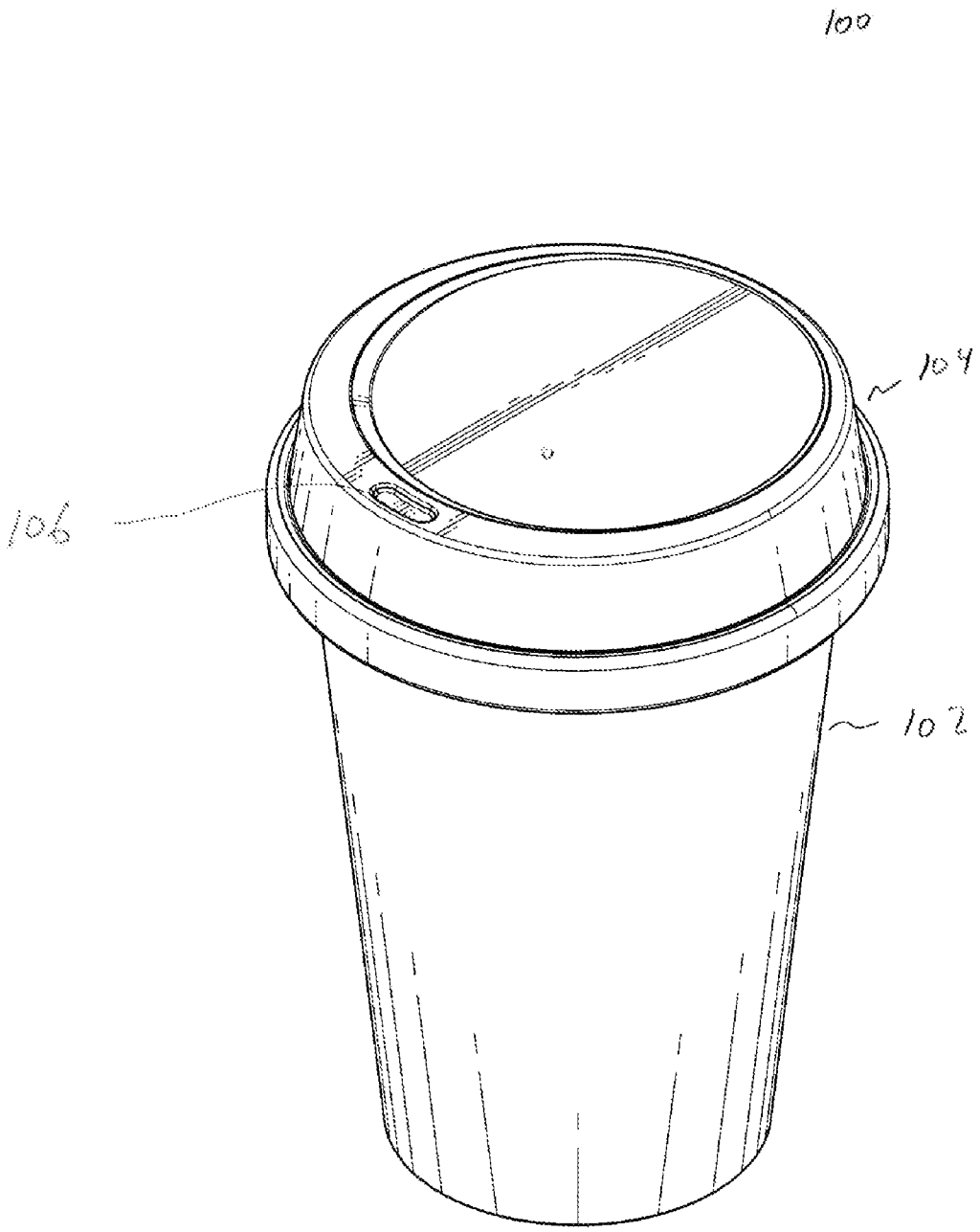
FIG. 1 shows a lidded ashtray according to the principles of the invention.
Figure 3:
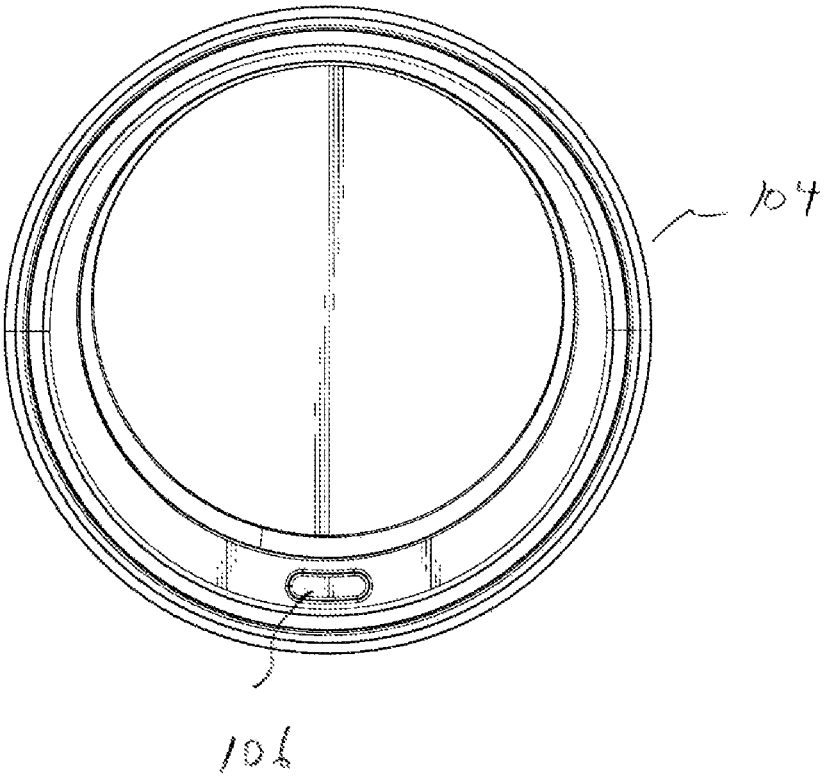
FIG. 3 shows a top view of the embodiment of FIG. 1.
Figure 4:
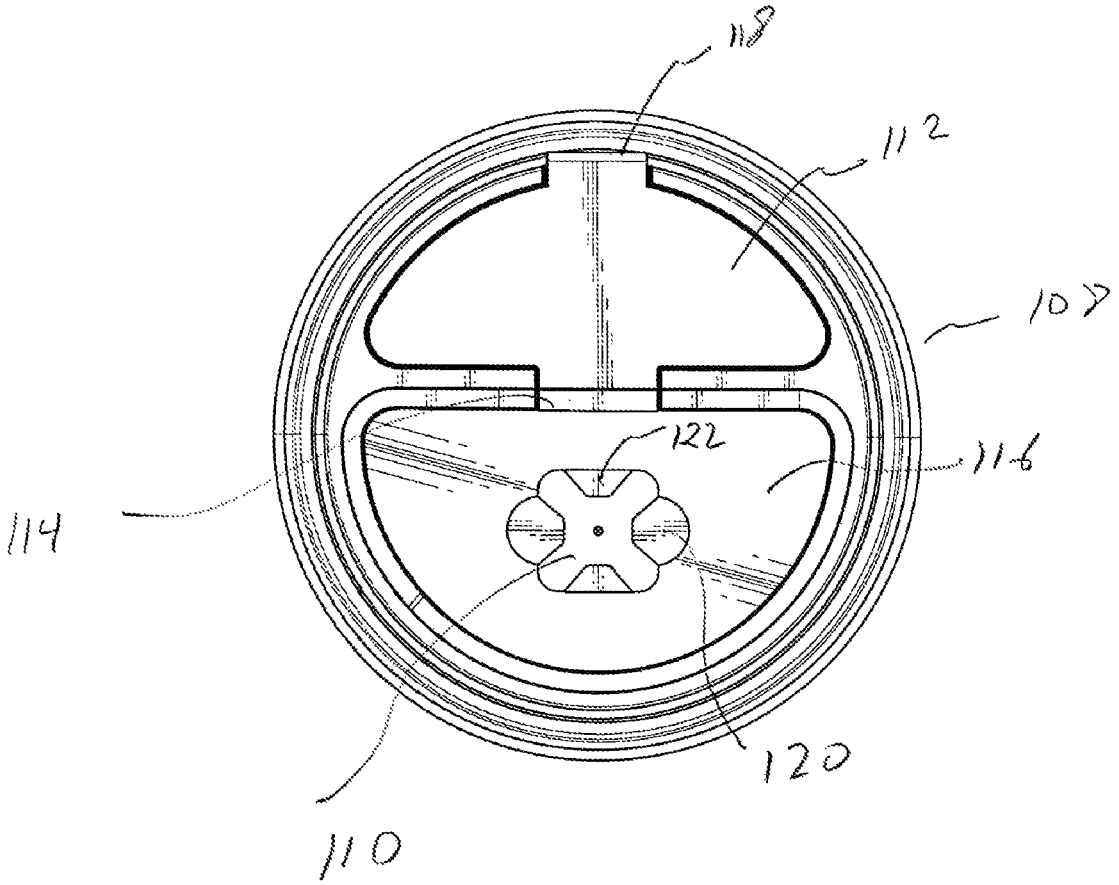
FIG. 4 shows a top view of the embodiment of FIG. 1 with the upper lid removed.
Figure 5:
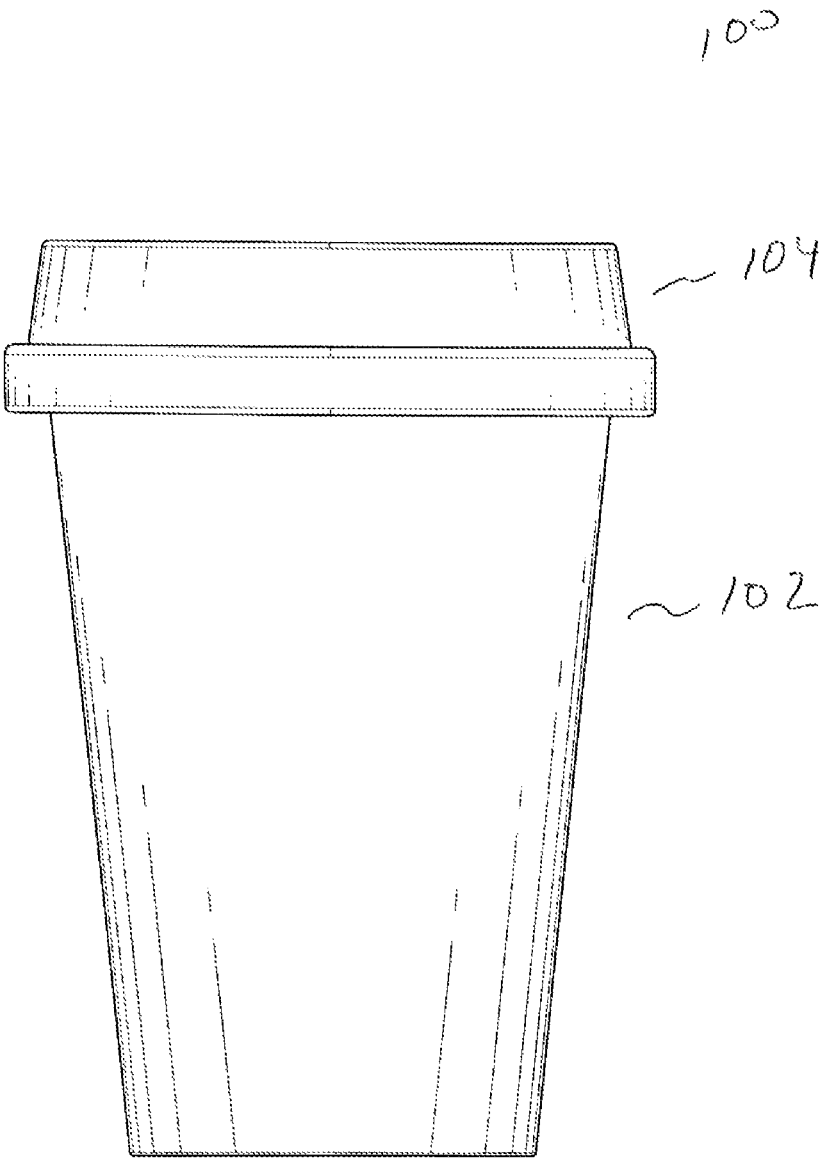
FIG. 5 shows a side view of the embodiment FIG. 1.

FIGS. 1 through 10 illustrate one embodiment of an ashtray and cache 100 according to the principles of the invention. In FIG. 1, the ashtray 100 is shaped and ornamented in the fashion of a lidded coffee cup. The configuration of FIG. 1. shows a perspective view illustrating the cup 102 with an upper lid 104. The upper lid 104 fits atop a second lid that comprises useful topological features for use as an ashtray, as will be further explained. FIG. 5 provides a side view of the exemplary ashtray 100.

Figure 7:
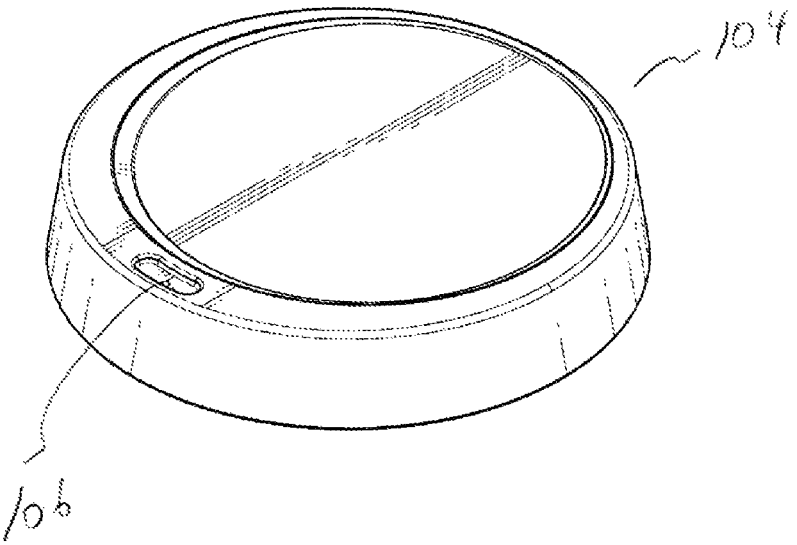
FIG. 7 shows a perspective view of the upper lid of the embodiment of FIG. 1.

FIGS. 3 and 7 show additional views of an exemplary lid 104. As can be seen, the lid is provided is ornamented to look like a typical coffee cup lid. The lid 104 is removable. An indentation 106 connotes a drinking aperture. In the exemplary embodiment 106, the indentation serves an ornamental purpose and the useful purpose of providing a tactile feature which a user can use to aid in removing the lid 104 from the container and applying the lid to the container 102.

In an embodiment of the invention, the cup 102 is made of heat resistant silicone. Silicone resists burning, warping, melting or other heat damage. Silicone can also accept labeling or printing by methods that would be known to the skilled artisan. Silicone can be configured in the illustrated or similar shapes by known manufacturing process. The lid 104 is made from odor resistant material, such as plastic. The lid 104 can also be made of silicone.

The ashtray and cache 100 may be sized to fit an ordinary cup holder, such as are typically used in passenger vehicles. The illustrated embodiment 100 comprises a cup 102 having a substantially flat bottom end with a diameter less than the opening diameter defined at the open end of the container, which results in a generally tapered shape. A person of ordinary skill in the art after reading this disclosure will understand that other shapes can be used without departing from the principles of the invention. For example, the ashtray can be substantially cylindrical, or may have a wider diameter at the bottom end than the lid end. Likewise, the skilled artisan after reading this disclosure will understand that materials other than silicone can be used.

Figure 2:
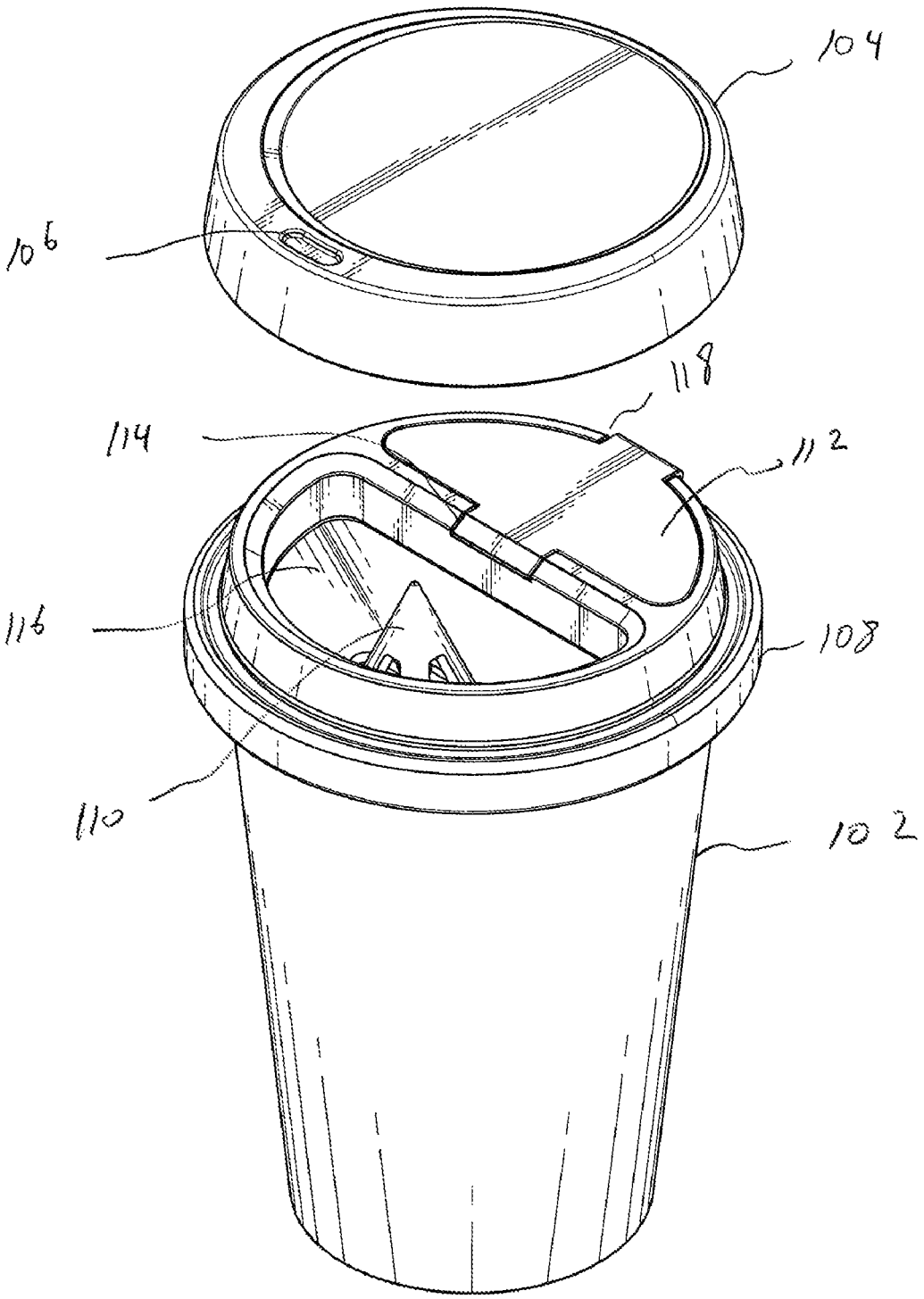
FIG. 2 shows the embodiment of FIG. 1 with the upper lid in an exploded view.
Figure 6:
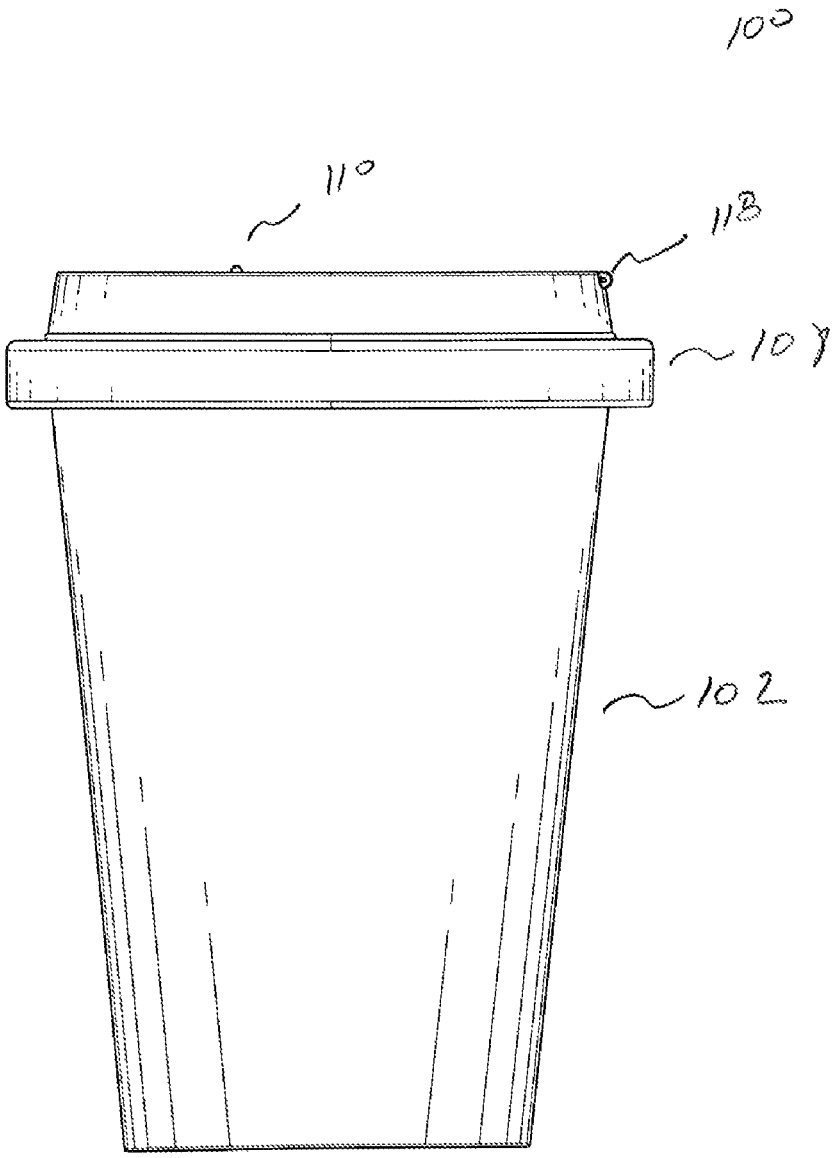
FIG. 6 shows a side view of the embodiment of FIG. 1 with the upper lid removed.

In FIG. 2, the ashtray 100 is shown in perspective view with upper lid 104 lifted to reveal lower lid 108. Lower lid 108 fits onto cup 102 and includes various features convenient for use as an ashtray. Bowl section 116 defines an indentation or bowl for use as a working space for a user's smokables. A pyramid shaped protrusion 110 is provided within the working space 116. This can be used to remove ashes from a smokable, remove ash from a bowl, or the like, and is hereafter also called a debowler. Features for use in assisting ash removal or shaping in connection with a smokable are referred to generically as ash working features. The pyramid shape allows the debowler to be used with a wide range of bowl sizes and shapes. The edges of the pyramid provide scrapers for helping to remove ash and debris from a bowl or to shape the ash of a smokable. In the exemplary embodiment, the pyramid has a base dimension of about 18 mm tapering to a point. In as side view as shown in FIG. 6, an exemplary relative height of debowler 110 is shown along with an illustrative implementation of hinge 118.

Lower lid 108 also features a hinged cover 112, which, in this view, closes an aperture to the storage section of container 102. An optional pull tab 114 opposite the hinge 118 provides for easy opening of the cover 112. When in the closed position, as shown in FIG. 2, a press fit or interference fit keeps the cover 112 secure. A person of ordinary skill in the art after reading this disclosure will understand that the cover 112, hinge 118, and tab 114 can be implemented in different ways without departing from the invention.

Figure 8:
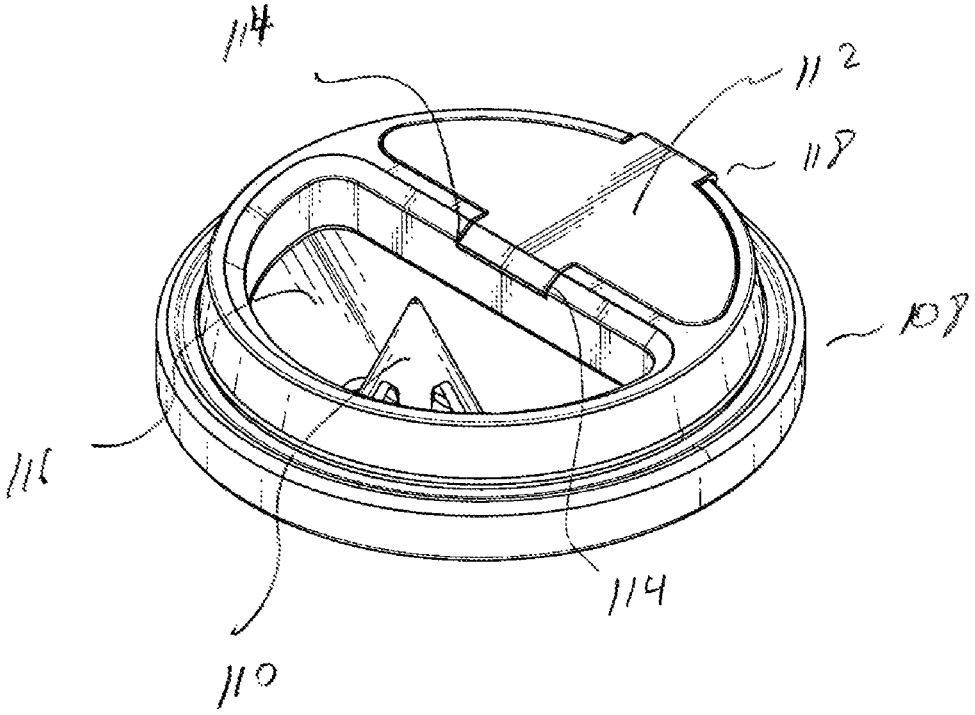
FIG. 8 shows a perspective view of the ashtray lid features of the embodiment of FIG. 1.

FIGS. 4 and 8 provide a top and perspective view of lid 108, respectively. In FIG. 4, aperture 120 is defined by the base of protrusion 110. This aperture 120 provide an opening to the waste section of container 110. The walls of debowler 110 define wall apertures 122, as shown in FIGS. 4 and 8. The edges of the apertures 122 provide additional scraping surfaces to the debowler 110. A user working ash off a smokable or cleaning a bowl generates waste ash that will collect in bowl 116. This ash will also fall through the aperture 120 into the container 102 until the user can clean the ashtray 100.

Figure 9:
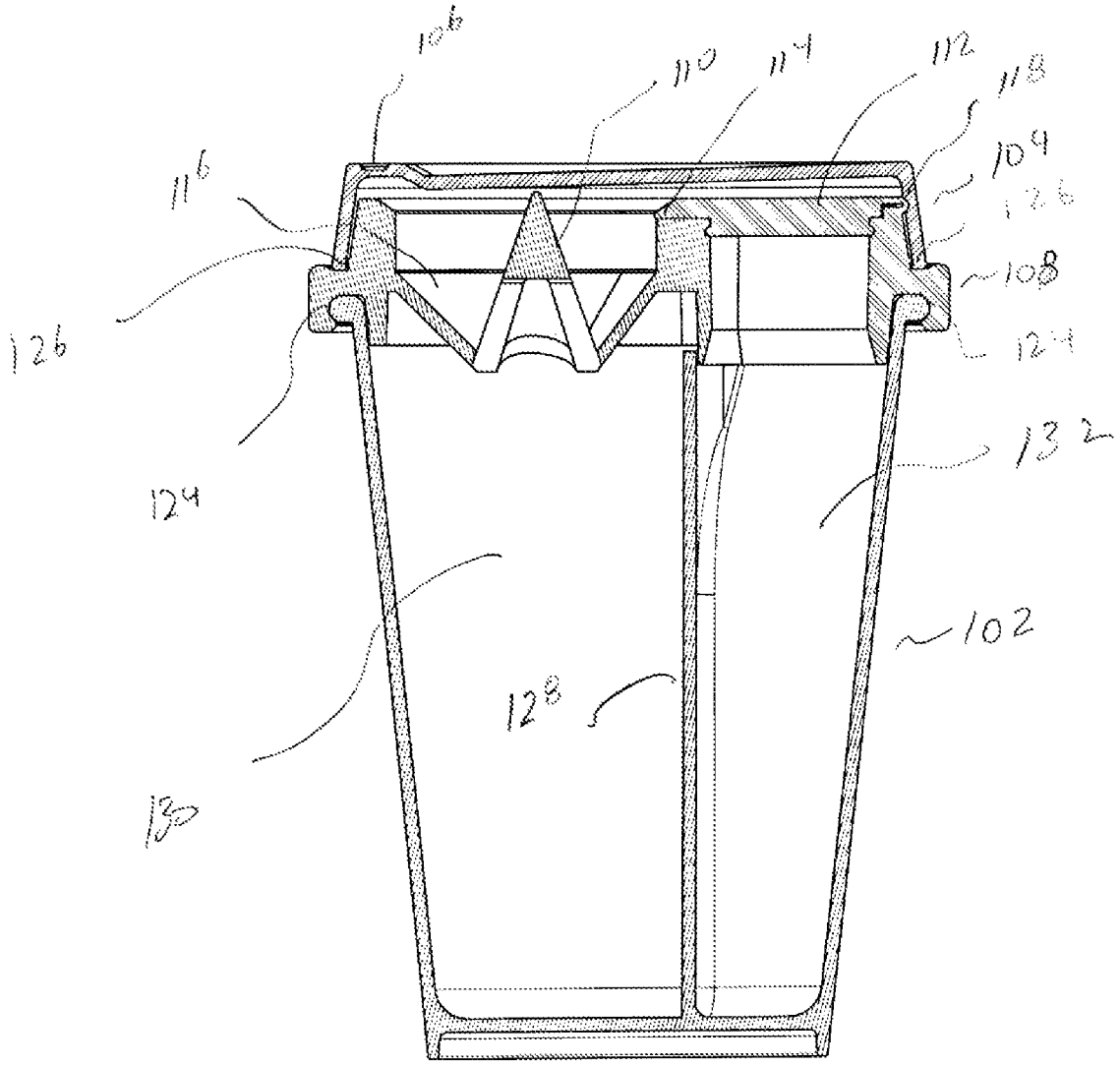
FIG. 9 shows a cross-sectional cut away view of the embodiment of FIG. 1.
Figure 10:
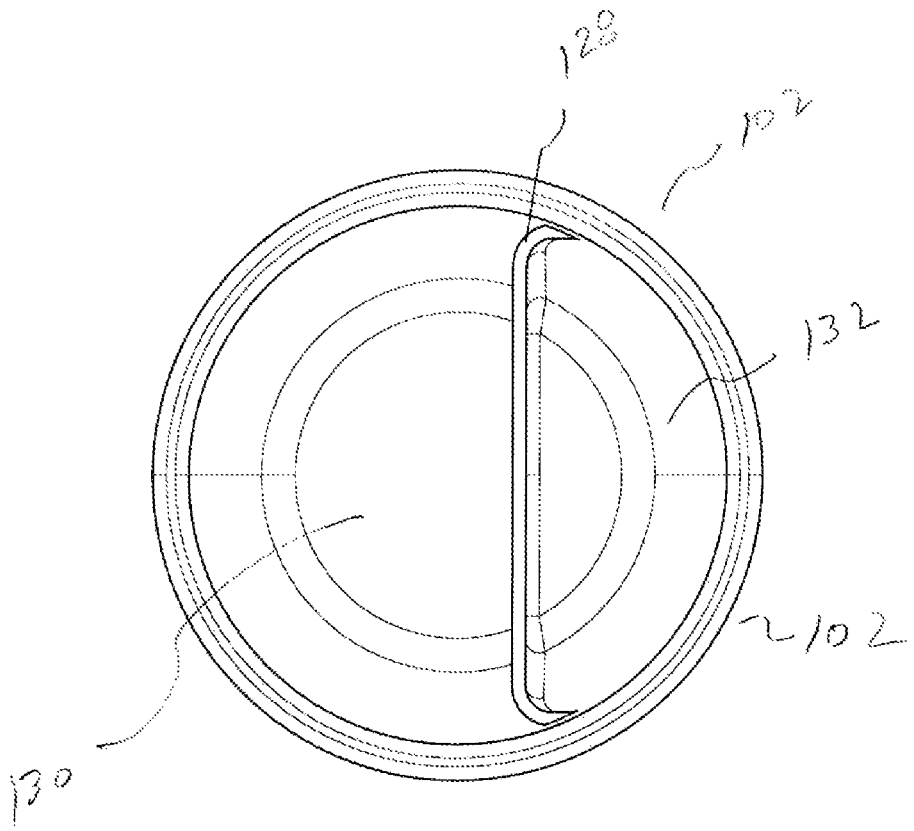
FIG. 10 shows a top view of the embodiment of FIG. 1 with the lids removed.

FIG. 9 shows a cross-section of the ashtray and cache cup 100 with both lower lid 108 and upper lid 104 in place. In this embodiment, the inner volume of container 102 is sectioned into two volumes 130 and 132 by inner sectioning wall 128. As can be seen, the sectioning wall 128 is positioned such that volume 130 is greater than volume 132. The greater volume 130 is positioned beneath the debowler 110 and related apertures, and can receive ash or waste from the bowl 116. The other volume 132 acts as the storage cache and is positioned beneath hinged 118 cover 112. FIG. 10 shows a top view of the cup 102. Sectioning wall 128 divides the inner volume into a waste catching volume 130 and the storage cache 132. A person of ordinary skill in the art after reading this disclosure that the sectioning wall 128 may be selectively placed to define desired volume proportions. The skilled artisan will also understand that additional sections can be created without departing from the principles of the invention.

Lower lid 108 is held in position to the cup 102 with an interference fit 124 or press fit. Upper or covering lid 104 fits to the lower lid 108 with a mechanical interfit 126. To use the ashtray, the user removes upper lid 104 to access either the bowl workspace 116 or the cache cover 112. Lifting the cache cover permits access to whatever is stored in the cache volume 132. As will be appreciated, the entire assembly comes easily apart for cleaning. A person of ordinary skill in the art will understand that other mechanical fits can be provided for removably affixing the upper lid to the lower lid and the lower lid to the container.

In the exemplary embodiment, the components are made from heat resistant silicone using known manufacturing methods. In addition to its heat resistant properties, silicone is shatterproof, easy to clean and provides a pleasing texture. A person of ordinary skill in the art having read this disclosure will understand how to make and use an ashtray according to the principles of the invention with silicone or similar materials.

An exemplary cup can have the following approximate dimensions for the described features.

| | |
|---|---|
| Cup Height | 115 mm |
| Top Cup Diameter | 100 mm |
| The Bottom Cup Diameter | 85 mm |
| Debowler Height From Lower Bowl Surface | 23 mm |
| Debowler Base Width | 18 mm |
| Bowl Depth | 15 mm |
| Distance From Nearest Top Cup Edge to Inner Wall | 38 mm |

The skilled artisan will understand that the dimensions are merely illustrative and that other dimensions can be implemented without departing from the principles of the invention. Such dimensional alterations are considered within the scope of the invention.

Likewise, the skilled artisan having read this disclosure will understand that the principles of the invention can be practiced using different shapes for the container and lids, different dimensions for the container and lids, and implementing more or less inner volume sections than shown here. A skilled artisan will understand from reading this disclosure that individual features and be included or excluded while practicing the invention. The skilled artisan after reading this disclosure will understand that different mechanical fits can be used between the covers and the container. The skilled artisan will understand that the debowler can be varied in size and shape and that other physical features for enhancing the ashtray function, such as ridges and textures, can be included. The sizes, shapes and number of apertures can be varied.

All the novel and useful features and combinations of features are enabled by this disclosure are understood to be within the scope of the invention.

What is claimed is:

1. An ashtray assembly comprising:

a container including a substantially flat bottom end, and defining a planar opening at another end and an interior volume; and, a first lid configured to removably cover the planar opening, the first lid having a top surface configured to define a workspace for a smokable, the workspace further defining at least one ash working feature, the ash working feature further defining an aperture providing mechanical communication between the workspace and the interior volume;

wherein the ash working feature includes a debowler comprising a pyramid shape wherein a base of the pyramid shape defines the aperture.

2. The assembly of claim 1 wherein the assembly comprises heat resistant silicone.

3. The assembly of claim 1 wherein the first lid workspace further defines a plurality of ash working features.

4. The assembly of claim 1 wherein the first lid workspace further defines a plurality of apertures.

5. The assembly of claim 1 further comprising a second lid configured to removably and substantially cover the first lid.

6. An ashtray assembly comprising:

a container including a substantially flat bottom end, and defining a planar opening at another end and an interior volume, the container further includes an interior sectioning wall spanning a height and width of the container interior substantially dividing the substantially flat bottom end and the interior volume into a first volume and a second volume; and, a first lid configured to removably cover the planar opening, the first lid having a top surface configured to define a first section including a workspace for a smokable, the workspace further comprising a pyramid shaped ash working feature defining at least one aperture, and a second section defining a second section aperture, wherein the container further includes an interior sectioning wall spanning a height and width of the container interior substantially dividing the interior volume into a first volume and a second volume, wherein the first lid workspace is substantially positioned over the first volume when the first lid covers the container.

7. The assembly of claim 6 wherein, when covering the container, the at least one aperture of the workspace is in mechanical communication with the first volume and the second section aperture is in mechanical communication with the second volume, and the interior sectioning wall and the first lid define a mechanical barrier such that the first volume and second volume maintain mechanical separation.

8. The assembly of claim 6 wherein the first lid further comprises a hinged cover which when closed substantially covers the second section aperture and which when open provides access to the second volume.

9. The assembly of claim 8 further comprising a second lid configured to removably cover the first lid.

10. A cup lid comprising a heat resistant and resilient material and defining:

a substantially circular shape having a diameter and a circumference;

a top surface configured to define a workspace for a smokable, the workspace further defining a top surface aperture and having an ash working feature extending upwardly from the top surface, the ash working feature further defining an ash working aperture in mechanical communication with the top surface aperture;

a bottom surface defining an annular indentation around the circumference of the circular shaped lid, wherein the cup lid is removably affixable on a cup opening defined by a rim of substantially similar circumference and diameter to the circular shape diameter and circumference by inserting the rim into the indentation; wherein the ash working feature includes a debowler having a pyramid shape and wherein a pyramid base and pyramid walls define the ash working aperture.

11. The assembly of claim 10 wherein the heat resistant and resilient material comprises heat resistant silicone.

12. The assembly of claim 10 wherein the first lid workspace further defines a plurality of ash working features.

13. An assembly comprising a cup lid according to claim 10 further comprising a second lid configured to removably and substantially cover the cup lid.

14. The assembly of claim 10 wherein the second lid comprises a substantially odor proof material.

15. An ashtray assembly comprising:

a container including a substantially flat bottom end, and defining a planar opening at another end and an interior volume, the container further including an interior sectioning wall spanning a height and width of the container interior dividing the interior volume into a first volume and a second volume; and, a first lid configured to removably cover the planar opening, the first lid having a top surface configured to define a workspace for a smokable, the workspace further defining at least one aperture, wherein the first lid workspace is positioned over the first volume when the first lid covers the container.

16. The assembly of claim 15 wherein, when covering the container, the first lid defines a first section corresponding to the first volume, the first section defining the workspace, and a second section corresponding to the second volume, the second section defining a second section aperture, wherein the at least one aperture of the workspace is in mechanical communication with the first volume and mechanically separate from the second volume, and the second section aperture is in mechanical communication with the second volume and mechanically separate from the first volume.

17. The assembly of claim 15 wherein the first lid further comprises a hinged cover which when closed substantially covers the second section aperture and which when open provides access to the second volume.

18. The assembly of claim 15 further comprising a second lid configured to removably cover the first lid.

* * * * *